US011568823B2

(12) United States Patent
Shen et al.

(10) Patent No.: US 11,568,823 B2
(45) Date of Patent: Jan. 31, 2023

(54) DRIVING METHOD OF DISPLAY PANEL AND DISPLAY DEVICE

(71) Applicant: Everdisplay Optronics (Shanghai) Co., Ltd., Shanghai (CN)

(72) Inventors: Fei Shen, Shanghai (CN); Xiangshu Li, Shanghai (CN); Xiangyu Jiang, Shanghai (CN); JehYen Kang, Shanghai (CN); Shaodong Ma, Shanghai (CN); Keitaro Yamashita, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 17/398,040

(22) Filed: Aug. 10, 2021

(65) Prior Publication Data

US 2022/0051630 A1 Feb. 17, 2022

(30) Foreign Application Priority Data

| | | |
|---|---|---|
| Aug. 11, 2020 | (CN) | 202010799502.0 |
| Aug. 20, 2020 | (CN) | 202010843698.9 |
| Jan. 11, 2021 | (CN) | 202110033008.8 |

(51) Int. Cl.

| | |
|---|---|
| ***G09G 3/32*** | (2016.01) |
| ***G09G 3/3266*** | (2016.01) |
| ***G09G 3/3291*** | (2016.01) |

(52) U.S. Cl.

CPC ..... *G09G 3/3266* (2013.01); *G09G 3/3291* (2013.01); *G09G 2310/027* (2013.01); *G09G 2310/062* (2013.01)

(58) Field of Classification Search

CPC .. G09G 3/2022; G09G 3/2088; G09G 3/3208; G09G 3/3233; G09G 3/3266; G09G 3/3275; G09G 3/3291; G09G 3/3258; G09G 2300/0439; G09G 2300/0819; G09G 2300/0842; G09G 2300/0866; G09G 2310/0216; G09G 2310/0251; G09G 2310/027; G09G 2310/061; G09G 2310/062; G09G 2310/08;

(Continued)

(56) References Cited

U.S. PATENT DOCUMENTS

| | | | | |
|---|---|---|---|---|
| 2010/0134018 | A1* | 6/2010 | Tziony | H05B 45/37 315/122 |
| 2016/0148563 | A1* | 5/2016 | Tsuge | G09G 3/3233 345/76 |
| 2017/0092193 | A1* | 3/2017 | Na | G09G 3/3233 |

(Continued)

FOREIGN PATENT DOCUMENTS

| | | | |
|---|---|---|---|
| CN | 102855863 | A | 1/2013 |
| CN | 105103214 | A | 11/2015 |

(Continued)

OTHER PUBLICATIONS

1st Office Action dated Sep. 16, 2022 of Chinese Application No.202010799502.0.

(Continued)

*Primary Examiner* — Michael J Eurice
(74) *Attorney, Agent, or Firm* — Qinghong Xu

(57) ABSTRACT

The present disclosure relates to the field of display technology, and provides driving methods of a display panel and a display device.

19 Claims, 16 Drawing Sheets

(58) Field of Classification Search
CPC ..... G09G 2340/0435; G09G 2330/021; G09G 2330/028; G09G 2340/16
See application file for complete search history.

(56) References Cited

U.S. PATENT DOCUMENTS

| | | | | |
|---|---|---|---|---|
| 2017/0092198 | A1* | 3/2017 | Ryu | G09G 3/3275 |
| 2018/0122327 | A1 | 5/2018 | Kim et al. | |
| 2018/0261161 | A1* | 9/2018 | Ota | G09G 3/3233 |
| 2020/0202787 | A1 | 6/2020 | Do et al. | |
| 2021/0012711 | A1* | 1/2021 | Huang | G09G 3/3291 |
| 2022/0019757 | A1* | 1/2022 | Han | G06V 40/1318 |
| 2022/0036818 | A1* | 2/2022 | Yin | G09G 3/3233 |
| 2022/0037430 | A1* | 2/2022 | Lee | H01L 27/3265 |

FOREIGN PATENT DOCUMENTS

| | | | |
|---|---|---|---|
| CN | 105654890 | A | 6/2016 |
| CN | 205959595 | U | 2/2017 |
| CN | 106531105 | A | 3/2017 |
| CN | 106782259 | A | 5/2017 |
| CN | 106991944 | A | 7/2017 |
| CN | 107978279 | A | 5/2018 |
| CN | 108109583 | A | 6/2018 |
| CN | 108694905 | A | 10/2018 |
| CN | 109410832 | A | 3/2019 |
| CN | 109859667 | A | 6/2019 |
| CN | 109903725 | A | 6/2019 |
| CN | 110599958 | A | 12/2019 |
| CN | 110890073 | A | 3/2020 |
| CN | 111161663 | A | 5/2020 |
| CN | 111383594 | A | 7/2020 |
| EP | 3686875 | A1 | 7/2020 |
| JP | 2016139077 | A | 8/2016 |

OTHER PUBLICATIONS

1st Office Action dated Jul. 14, 2022 of Chinese Application No.202010843698.9.

* cited by examiner

DRIVING METHOD OF DISPLAY PANEL AND DISPLAY DEVICE

CROSS-REFERENCE TO RELATED APPLICATION

The present application claims the priority of the Chinese patent application number 202010799502.0 filed on Aug. 11, 2020, the Chinese patent application number 202010843698.9 filed on Aug. 20, 2020, and the Chinese patent application number 202110033008.8 filed on Jan. 11, 2021, the entire contents of which Chinese patent applications are incorporated herein by reference for all purposes.

TECHNICAL FIELD

The present disclosure relates to the field of display technology, and in particular, to driving methods of a display panel and a display device.

BACKGROUND

At present, most display panels are adopting variable refresh rate technology, which can change the refresh rate in different application scenarios and save power consumption. However, when the refresh rate of the display panel changes, its brightness also changes.

FIG. 1 shows the brightness change curve of a display panel measured by an optical measurement tool at the 32 gray scale and a refresh rate switched from 30 Hz to 60 Hz. In the pixel circuit of the display panel, due to the existence of transistor leakage and hysteresis effect, the brightness at the beginning of each frame is lower at low gray levels. The integral of the brightness curve is the average luminous brightness of the display panel. In FIG. 1, the first area 110 shows the brightness of the display panel when the refresh rate is 30 Hz, and the second area 120 shows the brightness of the display panel when the refresh rate is 60 Hz. It can be seen from FIG. 1 that the average luminous brightness of the display panel at 30 Hz is greater than the average luminous brightness at 60 Hz under the 32 gray scale.

Human eyes are very sensitive to brightness changes at low gray scales. Therefore, when the refresh rate of the display panel changes under low gray scales, the brightness changes are easily captured by human eyes, which not only affects the user experience, but also accelerates eye fatigue, damaging human eyes.

It should be noted that the information disclosed in the background art section above is only used to enhance the understanding of the background of the present disclosure, and therefore may include information that does not constitute the prior art known to those of ordinary skill in the art.

SUMMARY

An aspect of the present disclosure provides a driving method of a display panel, including: detecting the display panel entering a variable refresh rate mode; determining a target refresh rate range according to the refresh rate range of the variable refresh rate mode, the target refresh rate range being from a minimum value of the refresh rate range to a target threshold; according to a frame signal of a current frame, determining whether the refresh rate of the current frame is within the target refresh rate range; and if so, adjusting the first level voltage of the scan signal in the blanking phase of the current frame, so that the voltage difference between the first level voltage and the second level voltage of the scan signal in the blanking phase is greater than the voltage difference between the first level voltage and the second level voltage of the scan signal in the active phase of the current frame.

In some embodiments, when the scan signal is at the first level voltage, in the pixel circuit of the display panel, except for that the driving transistor that drives the light emitting element of the pixel circuit to emit light is in the on state, all the remaining transistors are in the off state. The scan signal acts on the control terminals of the remaining transistors, and in the blanking phase, the adjusted first level voltage of the scan signal reduces the current flowing through the light emitting element, through the parasitic capacitance generated by the remaining transistors in the pixel circuit.

In some embodiments, the transistors in the pixel circuit are all PMOS transistors, the first level voltage of the scan signal is a high level voltage VGH, and the second level voltage of the scan signal is a low level voltage VGL. The adjusting the first level voltage of the scan signal in the blanking phase of the current frame includes: increasing the high level voltage VGH of the scan signal in the blanking phase.

In some embodiments, the transistors in the pixel circuit are all NMOS transistors, the first level voltage of the scan signal is a low level voltage VGL, and the second level voltage of the scan signal is a high level voltage VGH. The adjusting the first level voltage of the scan signal in the blanking phase of the current frame includes: reducing the low level voltage VGL of the scan signal in the blanking phase.

In some embodiments, the pixel circuit of each pixel of the display panel includes: a first transistor, having the first terminal coupled to the initialization voltage terminal, the second terminal coupled to the first node, and the control terminal receiving the first scan signal; a second transistor, having the first terminal coupled to the data line, the second terminal coupled to the first node, and the control terminal receiving the second scan signal; the third transistor, having the first terminal coupled to the anode of the light emitting element, the second terminal coupled to the initialization voltage terminal, and the control terminal receiving the third scan signal; the driving transistor, having the first terminal coupled to the anode of the light emitting element, the second terminal coupled to the anode power terminal, and the control terminal coupled to the first node; and a storage capacitor, coupled between the first node and the anode power terminal. When the scan signal is at the first level voltage, the driving transistor is turned on, and the first transistor, the second transistor, and the third transistor are turned off.

In some embodiments, the adjusting the first level voltage of the scan signal in the blanking phase of the current frame includes: adjusting the first level voltages of the first scan signal, the second scan signal, and the third scan signal in the blanking phase, so that when the current frame enters the blanking phase, the first scan signal, the second scan signal, and the third scan signal are adjusted at the same time.

In some embodiments, the working process of the pixel circuit in the active phase includes: in a first reset phase, turning on the first transistor in response to the second level voltage of the first scan signal, and initializing, by the initialization voltage signal at the initialization voltage terminal, the control terminal of the driving transistor and the storage capacitor; in a charging phase, turning on the second transistor in response to the second level voltage of the second scan signal, and charging, by the data voltage signal of the data line, the control terminal of the driving transistor and the storage capacitor; in a second reset phase, turning on the third transistor in response to the second level voltage of the third scan signal, and initializing, by the initialization voltage signal, the anode of the light emitting element; and in a display phase, turning on the driving transistor to drive the light emitting element to emit light.

In some embodiments, after determining whether the refresh rate of the current frame is within the target refresh rate range, the method further includes: if not, maintaining the first level voltage of the scan signal in the blanking phase equal to the first level voltage of the scan signal in the active phase.

According to an aspect of the present disclosure, there is provided a driving method of an OLED display panel, including:

determine the initial power supply voltage of the data line according to the input data signal;

obtaining the adaptive adjustment voltage of the data line;

detecting the data signal processing phase in which the display panel is currently located;

If the display panel is currently in the active transmission phase, setting the power supply voltage of the data line to be the initial power supply voltage; and If the display panel is currently in the blanking phase, setting the power supply voltage of the data line to be the adaptive adjustment voltage.

In some embodiments, the determining the initial power supply voltage of the data line according to the input data signal includes determining the initial power supply voltage of the data line according to the initial reference voltage and the input data signal.

In some embodiments, the obtaining the adaptive adjustment voltage of the data line includes the following steps:

obtaining an adaptive adjustment reference voltage; and determining the adaptive adjustment voltage of the data line according to the adaptive adjustment reference voltage and the input data signal.

In some embodiments, the method further includes adopting the following steps to set the adaptive adjustment reference voltage:

choosing a reference refresh frequency;

for the i-th refresh frequency, obtaining the adaptive adjustment reference voltage corresponding to the i-th refresh frequency through the frequency switch process between the refresh frequency and the reference refresh frequency, where $i \in (1, n)$, and n is the category number of refresh frequencies different from the reference refresh frequency.

In some embodiments, the frequency switch process includes the following steps:

adjusting the adaptive adjustment reference voltage, so that the display panel does not flicker when switching between the reference refresh frequency and the i-th refresh frequency, and recording the current adaptive adjustment reference voltage as the adaptive adjustment reference voltage corresponding to the i-th refresh frequency.

In some embodiments, the power supply voltage $V_{DATA}$ of the data line meets the following formula (1):

$$V_{DATA} = GammaH - \frac{GammaH - GammaL}{2^{bit} - 1} \times \text{Data} \quad (1)$$

wherein, Data is the input parameter obtained according to the input data signal of the data line, bit is a preset coefficient, GammaH and GammaL are preset reference voltages, where GammaH is the maximum reference voltage, and GammaL is a preset minimum reference voltage, the value of Data has a fixed correspondence with the input data signal of the data line, and the value range of Data is $0-(2^{bit}-1)$.

The initial reference voltage includes an initial GammaH value and an initial GammaL value.

The adaptive adjustment reference voltage includes an adaptive adjustment GammaH value and the initial GammaL value, or the initial GammaH value and an adaptive adjustment GammaL value, or an adaptive adjustment GammaH value and an adaptive adjustment GammaL value.

In some embodiments, after detecting the data signal processing phase in which the display panel is currently located, the method further includes the following steps:

determining whether the data signal processing phase in which the display panel is currently located is consistent with the data signal processing phase at the previous moment;

if being consistent, keeping the current reference voltage unchanged; and if being inconsistent, adjusting the current reference voltage.

In some embodiments, the adjusting the current reference voltage if being inconsistent includes the following steps:

if the display panel is currently in the blanking phase but in the active transmission phase at the previous moment, using the adaptive adjustment reference voltage to replace the reference voltage at the previous moment; and if the display panel is currently in the active transmission phase but in the blanking phase at the previous moment, using the initial reference voltage to replace the reference voltage at the previous moment.

An aspect of the present disclosure provides a driving method of a display device, including the steps:

generating a frame image signal, and outputting the frame image signal to the display device, the frame image signal including an active data region and a blanking region based on a time sequence;

detecting in real time whether the blanking interval of the frame image signal of the current frame starts; and if it starts, using the blanking interval of the frame image signal as the voltage transformation period, and changing the initialization voltage input to the display device during the voltage transformation period, to maintain the same average brightness under the change in frame rate.

In some embodiments, the duration of the voltage transformation period decreases as the frame rate increases, and the duration of the voltage transformation period increases as the frame rate decreases.

In some embodiments, the initialization voltage is switched from a preset voltage level to a regulated voltage level after the voltage transformation period starts.

In some embodiments, the initialization voltage is switched from a regulated voltage level to a preset voltage level after the voltage transformation period ends.

In some embodiments, when the frame rate of the frame image signal is equal to the highest frame rate of the display device, the voltage transformation period is cancelled.

In some embodiments, according to the duration of the frame image signal of the current frame, and based on the duration percentage of the preset voltage transformation period in the frame image signal, the increase or decrease value of the initialization voltage in the voltage transformation period of the current frame image signal is obtained.

In some embodiments, the initialization voltage is increased at least when the blanking region is displayed, so that the operating current of the display device is reduced.

In some embodiments, the decrease value of the initialization voltage in the voltage transformation period of the current frame image signal is obtained according to the duration of the active data region and the duration of the blanking region of the frame image signal of the current frame.

It should be understood that the above general description and the following detailed description are only exemplary and explanatory, and cannot limit the present disclosure.

BRIEF DESCRIPTION OF THE DRAWINGS

The drawings herein are incorporated into the specification and constitute a part of the specification, show embodiments in accordance with the present disclosure, and are used together with the specification to explain the principle of the present disclosure. Obviously, the drawings in the following description are only some embodiments of the present disclosure. For those of ordinary skill in the art, other drawings can be obtained based on these drawings without creative work.

DETAILED DESCRIPTION OF THE EMBODIMENTS

Figure 1:
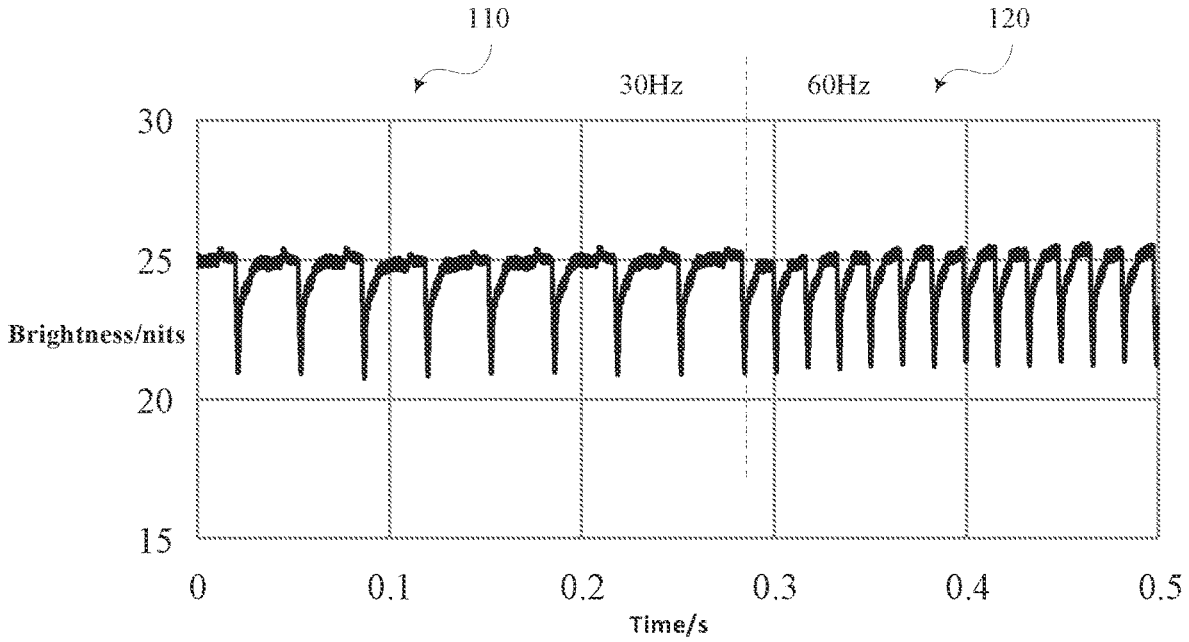
FIG. 1 shows the brightness change curve of an existing display panel at the 32 gray scale and the refresh rate switched from 30 Hz to 60 Hz.

Example embodiments will now be described more fully with reference to the accompanying drawings. However, the example embodiments can be implemented in various forms, and should not be construed as being limited to the embodiments set forth herein. On the contrary, these embodiments are provided so that the present disclosure will be comprehensive and complete, and will fully convey the concept of example embodiments to those skilled in the art. The same reference numerals in the figures indicate the same or similar structures, and thus their repeated description will be omitted.

In addition, the drawings are only schematic illustrations of the present disclosure, and are not necessarily drawn to scale. The same reference numerals in the figures denote the same or similar parts, and thus their repeated description will be omitted. Some of the block diagrams shown in the drawings are functional entities and do not necessarily correspond to physically or logically independent entities. These functional entities may be implemented in the form of software, or implemented in one or more hardware modules or integrated circuits, or implemented in different networks and/or processor devices and/or microcontroller devices.

The sequence numbers of the steps in the following embodiments are used to indicate different execution contents, and do not strictly limit the execution order between the steps. The "first", "second" and similar words used in the specific description do not indicate any order, quantity or importance, but are only used to distinguish different components. It should be noted that, in the case of no conflict, embodiments of the present disclosure and the features in different embodiments can be combined with each other.

Figure 2:
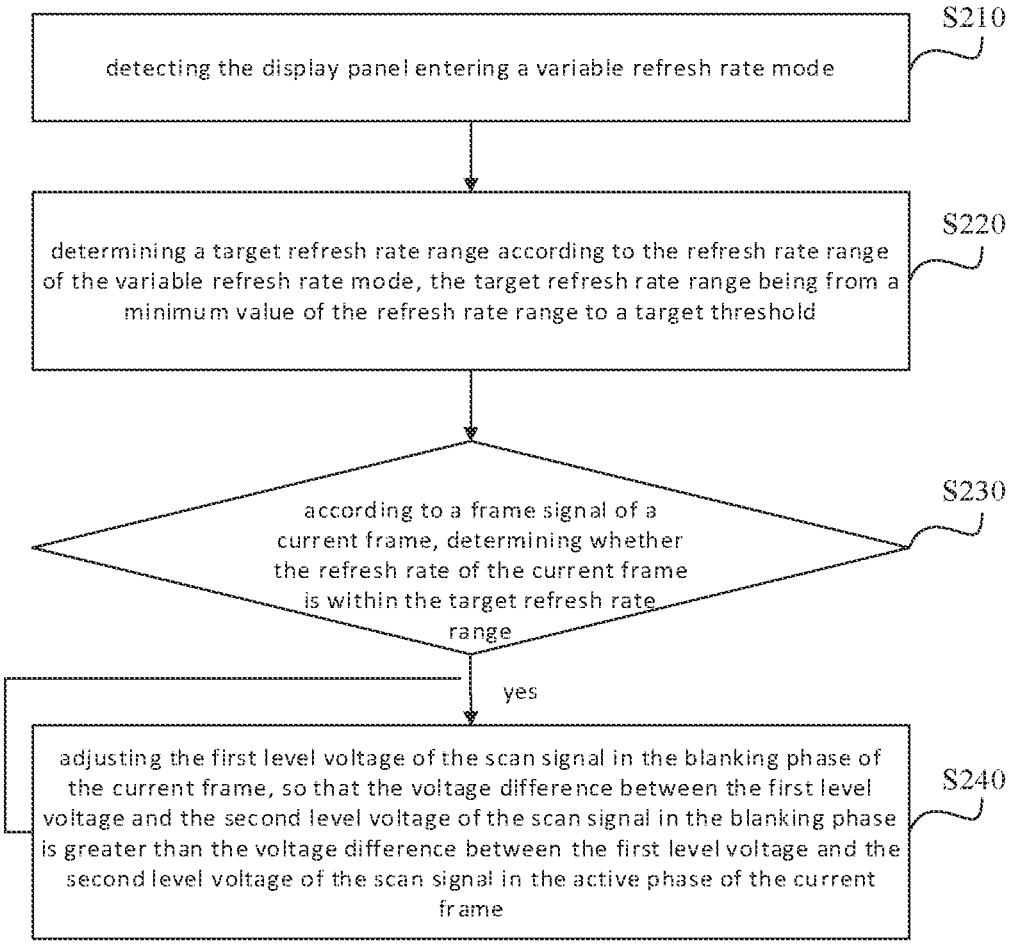
FIG. 2 shows a schematic diagram of the steps of a driving method of a display panel in an embodiment of the present disclosure.

FIG. 2 shows the main steps of the driving method of the display panel in an embodiment. Referring to FIG. 2, the driving method of the display panel in an embodiment includes the following steps.

In step S210, it is detected that the display panel enters the variable refresh rate mode.

Specifically, the timing controller of the display panel can detect each frame signal of the display panel to determine whether the display panel currently enters the variable refresh rate mode, so as to realize the subsequent adjustment of the display brightness of the display panel under the change in frequency.

In step S220, a target refresh rate range is determined according to the refresh rate range of the variable refresh rate mode, wherein the target refresh rate range is from a minimum value of the refresh rate range to a target threshold.

Because the display brightness of the display panel at a low refresh rate is higher than that at a high refresh rate, the low refresh rate range of the brightness to be adjusted is determined, and the display brightness of the display panel in the low refresh rate range is subsequently adjusted. The target threshold can be preset as needed, and can be a specific refresh rate value or a proportional value. For example, in an example, if the refresh rate range of the variable refresh rate mode is from 60 Hz to 25 Hz, and the target threshold is 40 Hz, the determined target refresh rate range is from 25 Hz to 40 Hz. As another example, in an embodiment, if the refresh rate range of the variable refresh rate mode is from 60 Hz to 25 Hz, and the target threshold is 80% of the maximum refresh rate in the refresh rate range, the determined target refresh rate range is from 25 Hz to 48 Hz.

In step S230, it is determined, according to a frame signal of a current frame, whether the refresh rate of the current frame is within the target refresh rate range.

In step S240, when it is determined that the refresh rate of the current frame is within the target refresh rate range, the first level voltage of the scan signal in the blanking phase of the current frame is adjusted, so that the voltage difference between the first level voltage and the second level voltage of the scan signal in the blanking phase is greater than the voltage difference between the first level voltage and the second level voltage of the scan signal in the active phase of the current frame.

When the refresh rate of the current frame is in the low refresh rate range, the level voltage of the scan signal in the blanking phase of the current frame is adjusted, so that the level voltage amplitude of the scan signal in the blanking phase is larger as compared with the level voltage amplitude in the active phase. Due to the existence of a variety of parasitic capacitances in the pixel circuit, increasing the amplitude of the level voltage of the scan signal during the blanking phase will cause the operating point of the light emitting element to shift and reduce the current flowing through the light emitting element, thereby reducing the display brightness of the display panel at a low refresh rate and making it consistent with the display brightness at a high refresh rate. This improves the brightness change caused by the change of the refresh rate and optimizes the user experience.

When the scan signal is at the first level voltage, in the pixel circuit of the display panel, except for that the driving transistor that drives the light emitting element of the pixel circuit to emit light is in the on state, the remaining transistors are all in the off state. The scan signal acts on the control terminals of the remaining transistors. In the blanking phase, the adjusted first level voltage of the scan signal reduces the current flowing through the light emitting element, through the parasitic capacitance generated by the remaining transistors in the pixel circuit.

In a specific example, when the transistors in the pixel circuit of the display panel are all PMOS transistors, the first level voltage of the scan signal is a high level voltage VGH, and the second level voltage of the scan signal is a low level voltage VGL. The adjustment of the first level voltage of the scan signal in the blanking phase of the current frame, specifically refers to increasing the high level voltage VGH of the scan signal in the blanking phase, so that the high level voltage VGH of the scan signal in the blanking phase of the current frame is larger than the high level voltage VGH of the scan signal in the active phase of the current frame. Thus, during the blanking phase of the current frame, the display brightness of the display panel is reduced, thereby reducing the overall display brightness of the display panel in the current frame.

In a specific example, when the transistors in the pixel circuit of the display panel are all NMOS transistors, the first level voltage of the scan signal is a low level voltage VGL, and the second level voltage of the scan signal is a high level voltage VGH. The adjustment of the first level voltage of the scan signal in the blanking phase of the current frame specifically refers to reducing the low level voltage VGL of the scan signal in the blanking phase, so that the low level voltage VGL of the scan signal in the blanking phase of the current frame is lower than the low level voltage VGL of the scan signal in the active phase of the current frame. Thus, during the blanking phase of the current frame, the display brightness of the display panel is reduced, thereby reducing the overall display brightness of the display panel in the current frame.

The principle of the driving method in an embodiment of the present disclosure will be described in detail below in conjunction with the pixel circuit of the display panel, wherein as an example, the transistors in the pixel circuit are all PMOS transistors. However, the present disclosure is not limited to the use of PMOS transistors.

Figure 3:
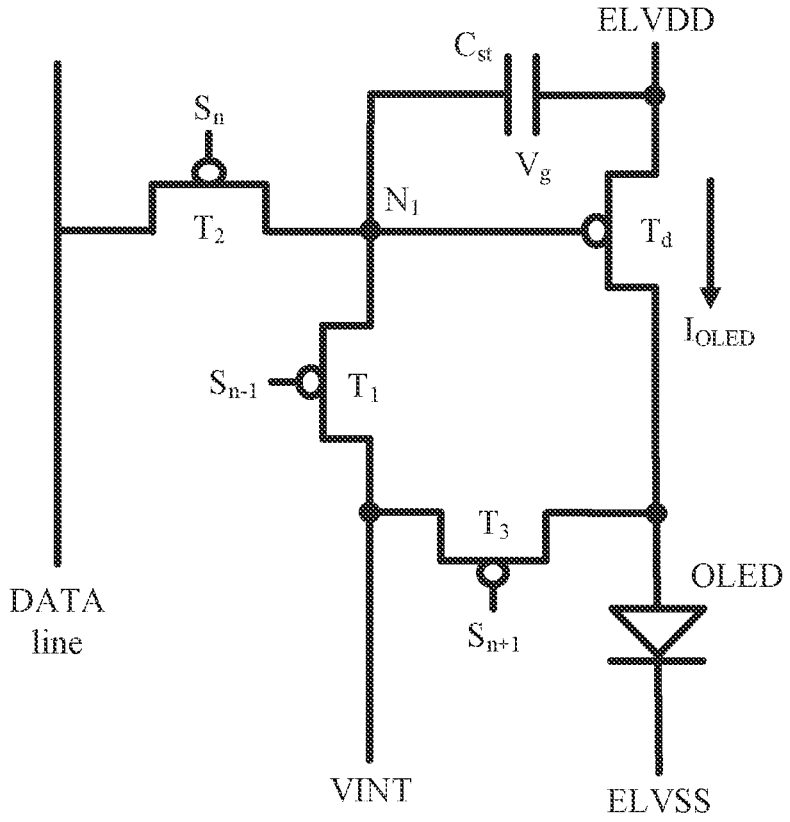
FIG. 3 shows a schematic diagram of a pixel circuit of each pixel of a display panel in an embodiment of the present disclosure.

FIG. 3 shows the pixel circuit of each pixel of the display panel in an embodiment. Referring to FIG. 3, the pixel circuit of a pixel in the display panel mainly includes: a first transistor $T_1$, having a first terminal coupled to the initialization voltage terminal VINT, a second terminal coupled to the first node $N_1$, and a control terminal receiving the first scan signal $S_{n-1}$; a second transistor $T_2$, having a first terminal coupled to the data line DATA line, a second terminal coupled to the first node $N_1$, and a control terminal receiving the second scan signal $S_n$; a third transistor T3, having a first terminal coupled to the anode of the light emitting element OLED, a second terminal coupled to the initialization voltage terminal VINT, and a control terminal receiving the third scan signal $S_{n+1}$; a driving transistor $T_d$, having a first terminal coupled to the anode of the light emitting element OLED, a second terminal coupled to the anode power terminal ELVDD, and a control terminal coupled to the first node $N_1$, wherein the cathode of the light emitting element OLED is coupled to the cathode power terminal ELVSS; and a capacitor $C_{st}$, coupled between the first node $N_1$ and the anode power terminal ELVDD.

In an embodiment, the first level voltage of the scan signal in the blanking phase of the current frame is adjusted, so that when the current frame enters the blanking phase, the high-level voltages VGH of the first scan signal $S_{n-1}$, the second scan signal $S_n$, and the third scan signal $S_{n+1}$ increase at the same time. The increasing amplitudes of the high level voltages VGH of the first scan signal $S_{n-1}$, the second scan signal $S_n$, and the third scan signal $S_{n+1}$ may be the same or different, which can be specifically determined by the circuit characteristics of the transistors on which the first scan signal $S_{n-1}$, the second scan signal $S_n$, and the third scan signal $S_{n+1}$ act. In a specific example, the high level voltages VGH of the first scan signal $S_{n-1}$, the second scan signal $S_n$, and the third scan signal $S_{n+1}$ may increase respectively by a preset value during the blanking phase of the current frame, wherein the preset value can have a certain range, such as from 0.1V to 5V.

In addition, the adjustment range of the high level voltage VGH is also related to the refresh rate. The lower the refresh rate, the higher the display brightness, the greater the brightness value that needs to be reduced, and the larger the adjustment range of the high level voltage VGH. Thus, the effect of changing different brightness at different frequencies can be achieved by the adjustment of the high level voltage VGH.

Blanking phase (Blanking) is the display interval phase between two frames, that is, the interval time from the end of one frame to the beginning of the next frame. The blanking phase of the current frame is located between the active phase of the current frame and the active phase of the next frame of the current frame. The frame signal of each frame contains parameter information related to the blanking phase. The duration of the blanking phase is sent by the graphics processing unit (GPU for short) of the display panel. For example, the duration of the blanking phase occupies 4% of the period of one frame. If the refresh rate of the frame signal is different, the duration of the corresponding blanking phase is also different. The blanking phase of the frame signal with a low refresh rate is long, and the blanking phase with a high refresh rate is short.

Figure 4:
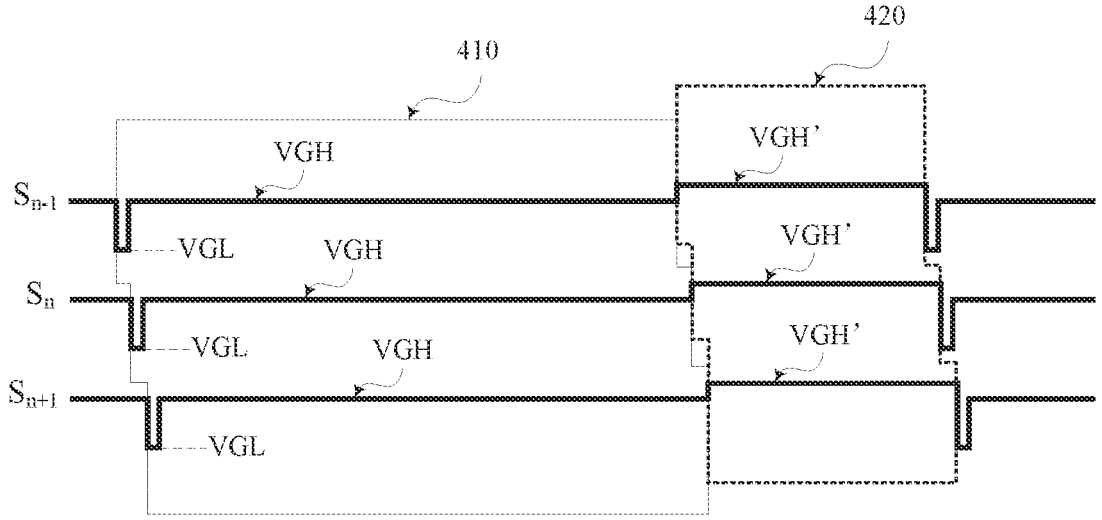
FIG. 4 shows a timing diagram of a scan signal of a current frame in an embodiment of the present disclosure.

FIG. 4 shows the timing of the scan signal of the current frame. Referring to FIG. 4, the entire phase of the frame period of the current frame includes an active phase 410 and a blanking phase 420. As shown in FIG. 3 and FIG. 4, the working process of the pixel circuit in the active phase 410 of the current frame includes the following steps.

In the first reset phase, the first transistor $T_1$ is turned on in response to the low level voltage VGL of the first scan signal $S_{n-1}$, and the initialization voltage signal of the initialization voltage terminal VINT initializes the control terminal of the driving transistor $T_d$ and the storage capacitor $C_{st}$. Thereafter, the first transistor $T_1$ is turned off under the action of the high level voltage VGH of the first scan signal $S_{n-1}$.

During the charging phase, the second transistor T2 is turned on in response to the low level voltage VGL of the second scan signal $S_n$, and the data voltage signal of the data line DATA line charges the control terminal of the driving transistor $T_d$ and the storage capacitor $C_{st}$. The storage capacitor $C_{st}$ stores a voltage of $V_g$. Thereafter, the second transistor $T_2$ is turned off under the action of the high level voltage VGH of the second scan signal $S_n$.

In the second reset phase, the third transistor $T_3$ is turned on in response to the low level voltage VGL of the third scan signal $S_{n+1}$, and the initialization voltage signal initializes the anode of the light emitting element OLED. Thereafter, the third transistor $T_3$ is turned off under the action of the high level voltage VGH of the third scan signal $S_{n+1}$.

In the display phase, the driving transistor $T_d$ is turned on under the action of the first node $N_1$ to drive the light emitting element OLED to emit light, wherein the current flowing through the light emitting element OLED is $I_{OLED}$.

Further, in the blanking phase, the first transistor $T_1$, the second transistor $T_2$, and the third transistor $T_3$ are kept off under the effect of the increased high level voltage VGH' of the first scan signal $S_{n-1}$, the second scan signal $S_n$, and the third scan signal $S_{n+1}$, respectively. Thus, the current $I_{OLED}$ flowing through the light emitting element OLED is reduced, thereby reducing the display brightness in the blanking phase.

Of course, in the blanking phase of the current frame, the high level voltage of each scan signal is adjusted to increase the high level voltage of each scan signal to VGH'. In the active phase of the next frame, the high level voltage of each scan signal is adjusted back to VGH; and according to whether the refresh rate of the next frame is within the target refresh rate range, it is determined whether the high level voltage of each scan signal needs to be adjusted in the blanking phase of the next frame. That is, during the active phase of each frame, the high level voltage of each scan signal remains the same to achieve the stability of the overall display effect. In the blanking phase of each frame, it is determined whether to adjust the high level voltage of each scan signal according to the refresh rate of the frame.

By increasing the high level voltage VGH of the scanning signal in the blanking phase, the current $I_{OLED}$ flowing through the light emitting element OLED is reduced. This is mainly because that in the pixel circuit, various parasitic capacitances exist between the transistor and the circuit (such as between the first transistor $T_1$/second Transistor T/third transistor $T_3$ and storage capacitor $C_{st}$). Thus, changing the size of the high level voltage VGH during the blanking phase will directly affect the operating point of the first transistor $T_1$/second transistor $T_2$/third transistor $T_3$ and the conduction conditions, thus causing a change in $V_g$ ($V_g$ is the voltage stored in the storage capacitor $C_{st}$). This directly causes the operating point of the driving transistor $T_d$ to shift, causing the current $I_{OLED}$ flowing through the light emitting element OLED to change. As a result, the brightness of the light emitting element OLED changes.

Specifically, in an actual application scenario, when the light emitting element OLED emits light, the first transistor $T_1$, the second transistor $T_2$, and the third transistor $T_3$ are turned off, the driving transistor $T_d$ is saturated, and the current $I_{OLED}$ flowing through the light emitting element OLED is subjected to the control of $V_{gs}$ ($V_{gs}=V_g-\text{ELVDD}$). According to the saturation region current formula under the ideal condition:

$$I_{OLED}=\tfrac{1}{2}\cdot\mu_p\cdot C_{OX}\cdot W/L\cdot(V_{gs}-V_{th})^2$$

$$=\tfrac{1}{2}\cdot\mu_p\cdot C_{OX}\cdot W/L\cdot(V_{data}+V_{th}-\text{ELVDD}-V_{th})^2$$

$$=\tfrac{1}{2}\cdot\mu_p\cdot C_{OX}\cdot W/L\cdot(V_{data}-\text{ELVDD})^2$$

wherein, $\mu_p$, $C_{OX}$ and W/L are all device parameters related to the driving transistor $T_d$. It can be seen that the current $I_{OLED}$ flowing through the light emitting element OLED is regulated by the data voltage $V_{data}$ (from the data line) and the anode voltage ELVDD (from the anode power supply terminal).

Adjusting the high level voltage VGH of the first scan signal $S_{n-1}$, the second scan signal $S_n$, and the third scan signal $S_{n+1}$ in the blanking phase will directly affect the gate voltage of the first transistor $T_1$, the second transistor $T_2$, and the third transistor $T_3$ in the off state. The first transistor $T_1$, the second transistor $T_2$ and the third transistor $T_3$ all have parasitic capacitances (gate capacitance and depletion layer capacitance). The parasitic capacitances will directly affect the leakage current of the first transistor $T_1$, the second transistor $T_2$ and the third transistor $T_3$.

When the light emitting element OLED emits light, $V_g\approx V_{data}+V_{th}$, wherein $V_{th}$ is the threshold voltage. At this time, although the first transistor $T_1$, the second transistor $T_2$, and the third transistor $T_3$ are all turned off, there are parasitic resistances in the source-drain region and the shallow source-drain front end, and there is also ohmic contact resistance between the source-drain region and the metal. These parasitic resistances will have a certain impact on the device. Taking the first transistor $T_1$ as an example, if the high level voltage VGH of the first scan signal $S_{n-1}$ is increased, a deeper depletion layer can be formed on the gate of the first transistor $T_1$ to reduce the leakage current of the first transistor $T_1$. Thereby, the partial voltage of the parasitic resistance is reduced, $V_{data}$ and $V_{th}$ are raised, and the current $I_{OLED}$ flowing through the light emitting element OLED is reduced, finally reducing the display brightness.

Figure 5:
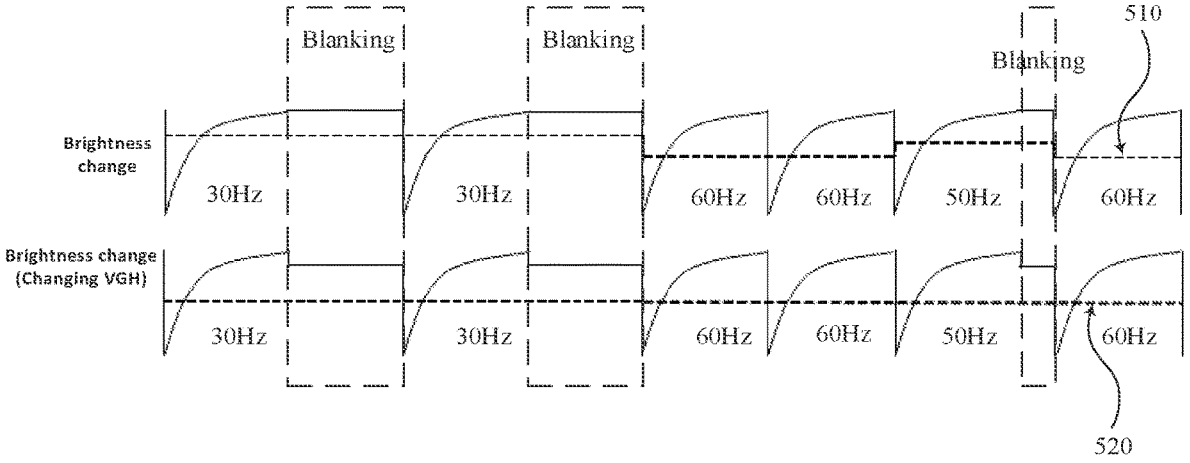
FIG. 5 shows a comparison schematic diagram, before and after the high level voltage VGH of the scan signal is adjusted, between the brightness change of an existing display panel and the brightness change of a display panel in an embodiment of the present disclosure.

FIG. 5 shows a comparison, before and after the adjustment of the high level voltage VGH of the scan signal, between the brightness change of an existing display panel and the brightness change of a display panel in an embodiment of the present disclosure. With reference to FIG. 5, the first brightness change curve 510 corresponds to the existing display panel, and the second brightness change curve 520 corresponds to the display panel in an embodiment of the present disclosure. According to the present disclosure, the high level voltage VGH of the scan signal is changed during the blanking phase of the frame with a low refresh rate, to reduce the brightness of the frame with a low refresh rate in the blanking phase, so that the average brightness at all refresh rates remains consistent. Furthermore, when the display panel is switched between different refresh rates, the brightness difference can be reduced, and the flicker phenomenon visible to human eyes can be reduced.

According to experimental results, based on the device characteristics of the first transistor $T_1$, the second transistor $T_2$, and the third transistor $T_3$, the initially set high level voltage VGH of the first scan signal $S_{n-1}$, the second scan signal $S_n$ and the third scan signal $S_{n+1}$ is 6.5V, and the display brightness of the display panel is 418.9 nit at the 32 gray scale and a refresh rate of 30 Hz. In the blanking phase, the high level voltage VGH of the first scan signal $S_{n-1}$, the second scan signal $S_n$, and the third scan signal $S_{n+1}$ is increased, and the brightness of the display panel is as follows:

| VGH/V | brightness/nit |
|---|---|
| 6.5 | 418.9000 |
| 8.5 | 396.3000 |
| 8 | 401.9000 |
| 7.5 | 410.0000 |
| 7 | 414.5000 |

It can be seen that increasing the high level voltage VGH in the blanking phase can reduce the brightness of the display panel during the blanking phase, and then reduce the brightness of the entire frame phase.

Further, when it is determined that the frame signal of the current frame is not within the target refresh rate range, it means that the refresh rate of the current frame is high, and there is no need to adjust the level voltage of the scan signal thereof. Therefore, the first level voltage of the scan signal in the blanking phase is kept equal to the first level voltage of the scan signal in the active phase.

Of course, in other embodiments, the level voltage of the scan signal can also be adjusted during the blanking phase of all frames, wherein the frame with a high refresh rate has a small adjustment amplitude, and the frame with a low refresh rate has a large adjustment amplitude. Thus, the display brightness of all frames after adjustment keeps the same.

To sum up, using the driving method in any of the above-mentioned embodiments of the present disclosure, the level voltage of the scan signal is adjusted during the blanking phase of a frame with a low refresh rate, which helps to reduce the current flowing through the light emitting element during the blanking phase, thereby reducing the display brightness of the display panel at a low refresh rate, and making it consistent with the display brightness at a high refresh rate. This improves the brightness change caused by the change of the refresh rate and optimizes the user experience.

Figure 6:
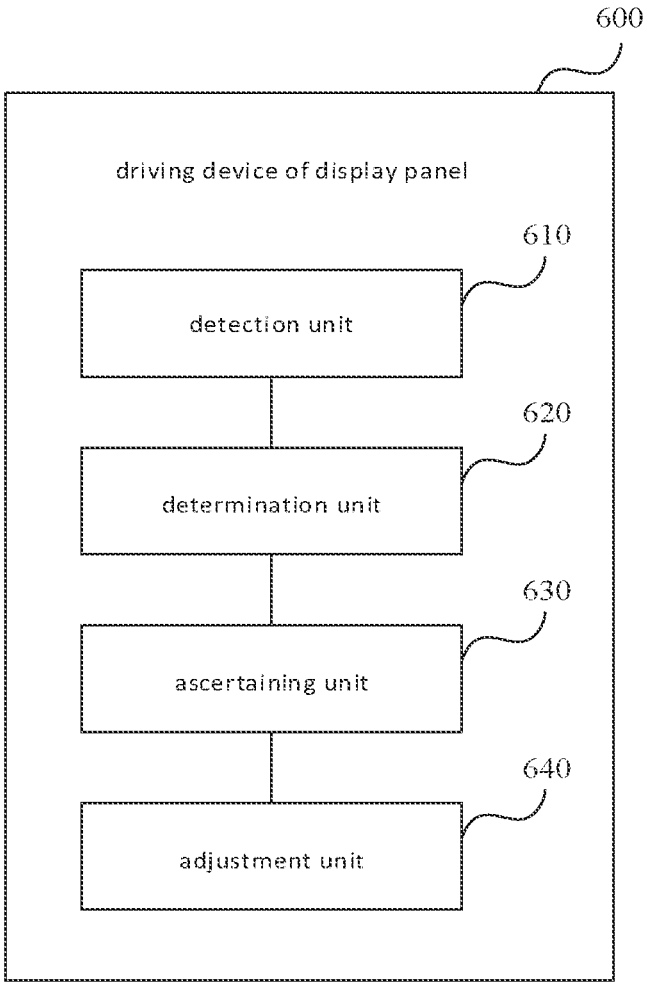
FIG. 6 shows a schematic module diagram of a driving device of a display panel in an embodiment of the present disclosure.

Embodiments of the present disclosure also provide a driving device of a display panel, which can be used to implement the driving method described in any of the foregoing embodiments. FIG. 6 shows the main modules of the driving device in an embodiment. As shown in FIG. 6, the driving device 600 in an embodiment includes: a detection unit 610, configured to detect the display panel entering the variable refresh rate mode and triggering a determination unit; the determination unit 620, configured to determine the target refresh rate range according to the refresh rate range of the variable refresh rate mode, wherein the target refresh rate range is from a minimum value of the refresh rate range to a target threshold; an ascertaining unit 630, configured to determine whether the refresh rate of the current frame is within the target refresh rate range based on the frame signal of the current frame, and if so, to trigger an adjustment unit; and the adjustment unit 640, configured to adjust the first level voltage of the scan signal in the blanking phase of the current frame, so that the voltage difference between the first level voltage and the second level voltage of the scan signal in the blanking phase is greater than the voltage difference between the first level voltage and the second level voltage of the scan signal in the active phase of the current frame.

The detection unit 610, the determination unit 620, the ascertaining unit 630, and the adjustment unit 640 can be respectively installed in the existing devices of the display panel. For example, the detection unit 610, the determination unit 620, and the ascertaining unit 630 are arranged in the timing controller, and the adjustment unit is arranged in the driving control chip. For the specific principles of each unit module in the driving device, reference may be made to the description of any of the above-mentioned driving method embodiments, which will not be repeated here.

Embodiments of the present disclosure also provide a display panel, which is configured with the above-mentioned driving device and is controlled by the above-mentioned driving method to emit light and display.

In summary, the display panel and its driving method and driving device of the present disclosure adjust the level voltage of the scan signal during the blanking phase of a frame with a low refresh rate, so as to reduce the current flowing through the light emitting element during the blanking phase, thereby reducing the display brightness of the display panel at a low refresh rate and keeping it consistent with the display brightness at a high refresh rate. Thus, the brightness change caused by the refresh rate change is improved, and the user experience is optimized.

Figure 7:
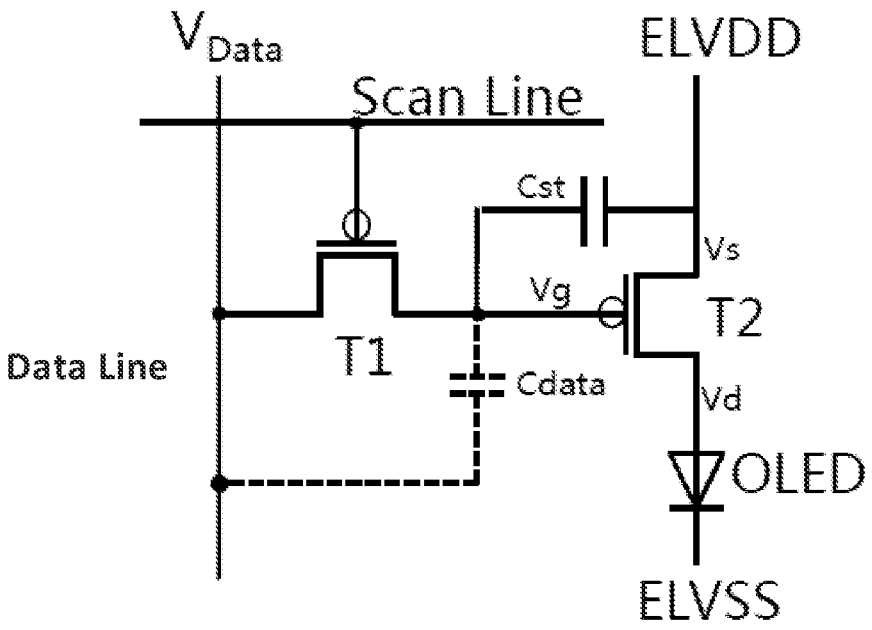
FIG. 7 is a schematic structural diagram of an OLED pixel driving circuit.

As shown in FIG. 7, it is a schematic structural diagram of an OLED pixel driving circuit. The pixel driving circuit includes an OLED transistor, a first transistor T1, a capacitor $C_{st}$, and a second transistor T2. Data Line represents the data line, $V_{Data}$ represents the power supply of the data line, Scan Line represents the scan line for controlling the opening and closing of the first transistor T1 (scanning TFT), and Vg represents the gate voltage of the second transistor T2 (driving TFT). There is a parasitic capacitance $C_{data}$ between the data line and the gate of the second transistor T2. When the first transistor T is turned off, if $V_{Data}$ changes, the voltage of Vg will change due to the existence of $C_{data}$.

Figure 8:
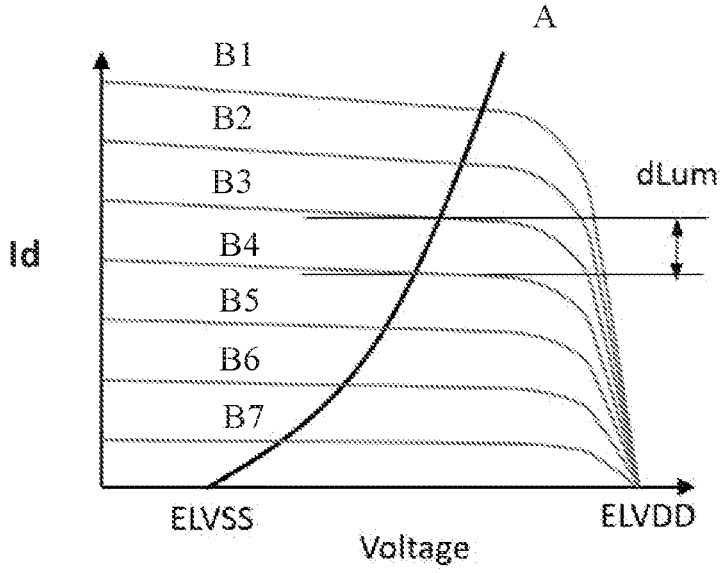
FIG. 8 is a schematic diagram of the influence on the brightness of the power supply voltage of the data line.

According to the Id-Vd characteristic curve of the TFT, the change of the voltage Vgs between the gate and the source of the TFT will cause the Id (the conduction current of the TFT) to change. The specific change is shown in FIG. 8. The curve A1 represents the current flowing through the OLED device (i.e., the conduction current of T2) varies with the magnitude of Vd. B1~B7 respectively represent the change curve of the current flowing through the OLED device (i.e., the conduction current of the second transistor T2) under different Vgs (the voltage difference between the gate and the source). dLum represents the brightness change value. When VData becomes larger, the gate voltage Vg of the second transistor T2 will increase, and the current $I_{OLED}$ of the OLED transistor will decrease, so that the OLED light emitting brightness decreases. When $V_{Data}$ becomes smaller, the gate voltage Vg of the second transistor T2 will decrease, and the current $I_{OLED}$ of the OLED transistor will increase, making the OLED light emitting brightness higher. Therefore, $V_{Data}$ can be changed to give a weak change of Vg, so as to control the current through the OLED and achieve the purpose of changing the brightness of the OLED.

Figure 9:
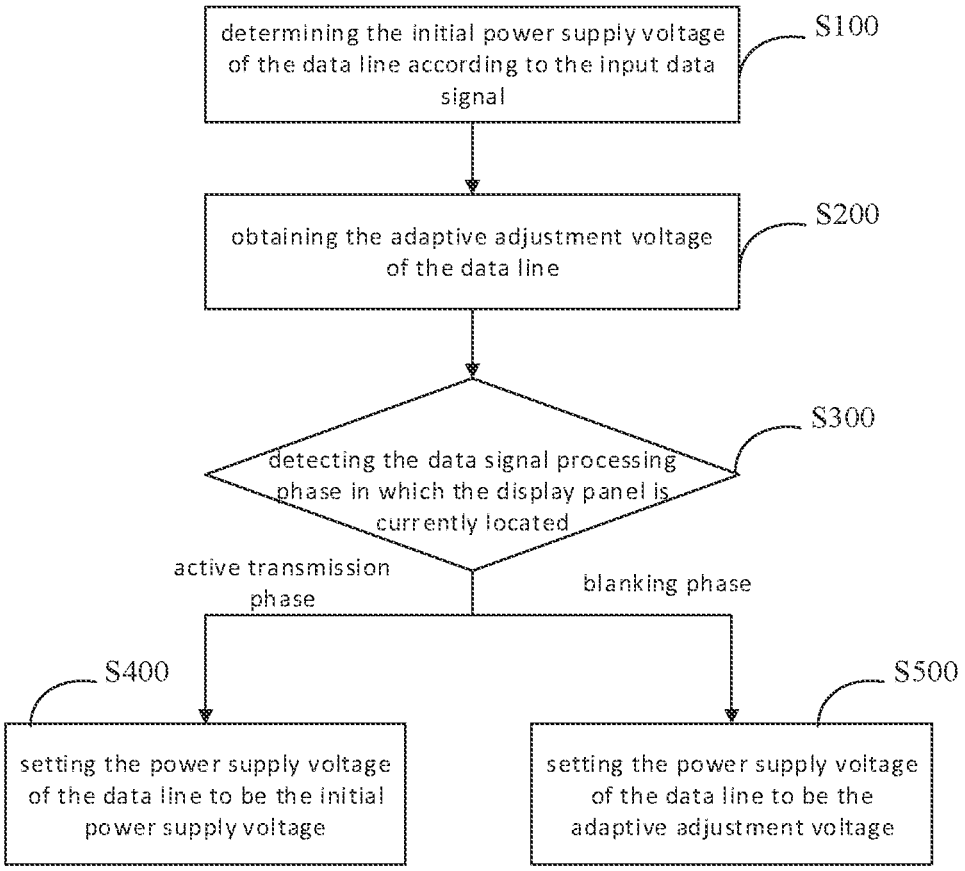
FIG. 9 is a flowchart of a driving method of an OLED display panel in an embodiment of the disclosure.
Figure 10:
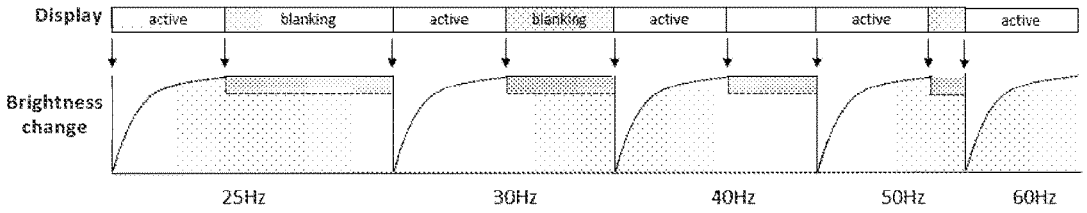
FIG. 10 is a schematic diagram for controlling under different refresh frequencies by adopting the driving method in an embodiment of the present disclosure.
Figure 11:
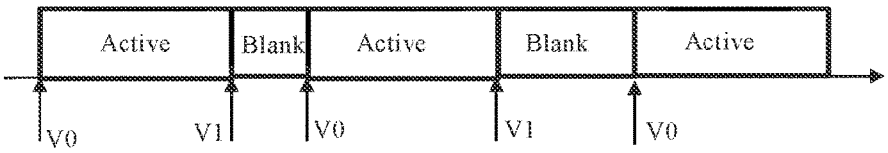
FIG. 11 is a schematic diagram of voltage changes at different phases using the driving method in an embodiment of the present disclosure.

As shown in FIGS. 9-11, an embodiment of the present disclosure provides a driving method of an OLED display panel, which includes the following steps.

In S100, the initial power supply voltage $V_0$ of the data line is determined according to the input data signal.

In S200, the adaptive adjustment voltage $V_1$ of the data line is obtained.

In S300, the data signal processing phase in which the display panel is currently located is detected. Specifically, the data signal processing phase includes an active transmission phase (active region) and a blanking phase (Blanking region). Specifically, the data signal processing phase in which the display panel is currently located can be detected by the timing controller T-CON.

In S400, if the display panel is currently in the active transmission phase, the power supply voltage of the data line is set to be the initial power supply voltage $V_0$.

In S500, if the display panel is currently in the blanking phase, the power supply voltage of the data line is set to be the adaptive adjustment voltage $V_1$.

Therefore, the present disclosure detects the data signal processing phase in which the display panel is currently located through step S300. Then, when the display panel is in the active transmission phase, i.e., the power supply voltage $V_{Data}$ of the data line is maintained in the active region as the initial power supply voltage $V_0$, and when the display panel reaches the blanking phase, i.e., the active video data transmission is completed, the power supply voltage $V_{Data}$ of the data line is changed to the adaptive adjustment voltage $V_1$ in the blanking region, thereby adjusting the average brightness in one frame. The lower the frequency, the higher the brightness. Therefore, when the blanking region is long, that is, when the refresh frequency is low, the changed power supply voltage $V_{Data}$ of the data line has a long action time, and the average brightness adjustment amount is large. When the blanking region is short, that is, when the refresh frequency is high, the changed power supply voltage $V_{Data}$ of the data line has a short action time, and the average brightness adjustment amount is small.

The adaptive adjustment voltage $V_1$ is an adaptive adjustment voltage obtained by adjusting the brightness of the display panel with reference to a reference refresh frequency. When the reference refresh frequency is selected as a higher frequency, the power supply voltage $V_{Data}$ of the data line needs to be increased at other frequencies. That is, at the same refresh frequency, the adaptive adjustment voltage $V_1$ is greater than the initial power supply voltage $V_0$. Therefore, when the blanking region is long, that is, when the refresh frequency is low, the changed power supply voltage $V_{Data}$ of the data line has a long action time, and the average brightness decreases more. When the blanking region is short, that is, when the refresh frequency is high, the changed power supply voltage $V_{Data}$ of the data line has a short action time, and the average brightness reduces less.

Figure 12:
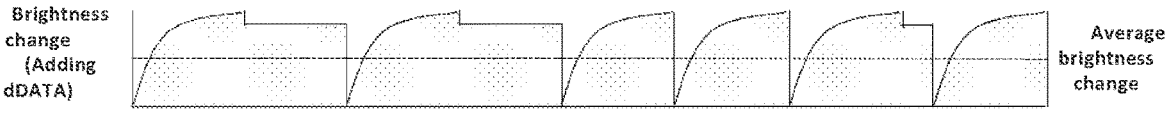
FIG. 12 is a schematic diagram of brightness changes when the frequency changes by using the driving method in an embodiment of the present disclosure.
Figure 13:
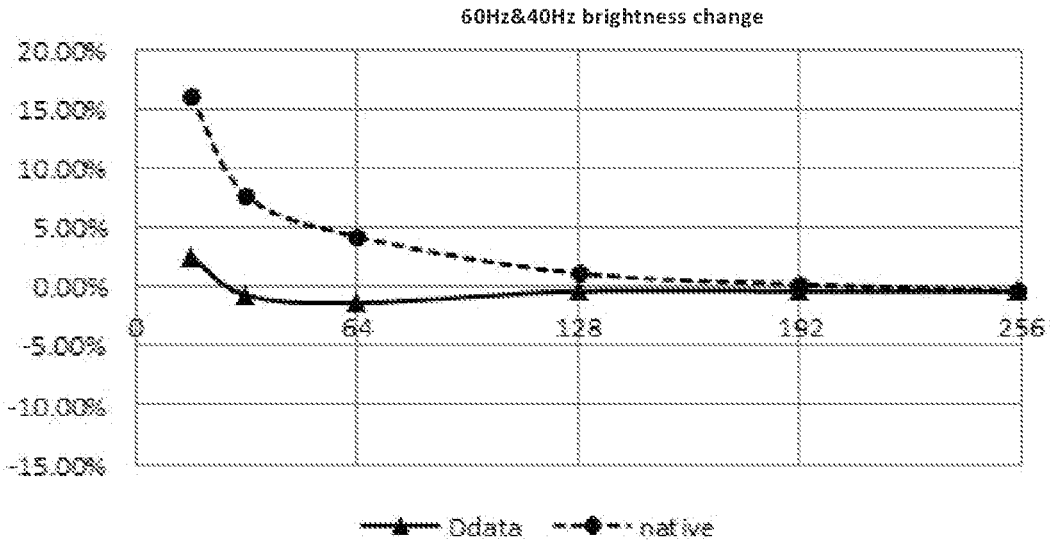
FIG. 13 is a graph of brightness changes between 60 Hz and 40 Hz using the driving method in an embodiment of the present disclosure.

As shown in FIG. 12, it is a schematic diagram of the brightness change under different refresh frequencies after using the driving method of the present disclosure. The dotted line represents the average brightness change. It can be seen that there is basically no brightness change when switching between different refresh frequencies, which can avoid human eyes seeing flicker. As in FIG. 13, the brightness change curve when switching between 60 Hz and 40 Hz is shown according to an embodiment of the present disclosure, wherein the abscissa is the gray scale, and the longitudinal coordinate is the percentage of brightness change at 40 Hz & 60 Hz. Each node on the curve corresponds to a specific gray scale (such as 64 gray level, 128 gray level, 192 gray level, etc.). Native represents the brightness change curve in the prior art, and Ddata represents the brightness change curve after adopting the driving method of the present disclosure, which can effectively reduce the difference in brightness change.

As shown in FIG. 11, in an embodiment, after detecting the data signal processing phase in which the display panel is currently located, the method further includes the following steps.

It is determined whether the data signal processing phase in which the display panel is currently located is consistent with the data signal processing phase at the previous moment. If they are consistent, the current power supply voltage of the data line is kept unchanged. If they are inconsistent, the current power supply voltage of the data line is adjusted. That is, the supply voltage is switched at the same time when the phase is switched.

In an embodiment, if the data signal processing phase in which the display panel is currently located is inconsistent with the data signal processing phase at the previous moment, the adjustment of the current supply voltage of the data line includes the following steps.

If the display panel is currently in the blanking region of the blanking phase but in the active region of the active transmission phase at the previous moment, the adaptive adjustment voltage $V_1$ is used to replace the initial power supply voltage $V_0$ at the previous moment. That is, the initial power supply voltage $V_0$ is modified to $V_1$ at the beginning of the blanking region of the blanking phase.

If the display panel is currently in the active region of the active transmission phase but in the blanking region of the blanking phase at the previous moment, the initial power supply voltage $V_0$ is used to replace the adaptive adjustment voltage $V_1$ of the previous moment. That is, the adaptive adjustment voltage $V_1$ is changed to $V_0$ at the end of the blanking region of the blanking phase.

In an embodiment, the determining the initial power supply voltage of the data line according to the input data signal includes determining the initial power supply voltage $V_0$ of the data line according to the initial reference voltage and the input data signal.

Due to the existence of the parasitic capacitance, the voltage difference between the data line and the gate of the second transistor T2 cannot undergo abrupt changes. When a sudden change occurs in the voltage of the data line, the corresponding gate voltage Vg of the second transistor T2 has a sudden change.

In an embodiment, the power supply voltage $V_{DATA}$ of the data line meets the following formula (1), which is a formula used for gamma correction:

$$V_{DATA} = GammaH - \frac{GammaH - GammaL}{2^{bit} - 1} \times \text{Data} \quad (1)$$

wherein, Data is the input parameter obtained according to the input data signal of the data line, bit is a preset coefficient, generally a fixed segment, GammaH and GammaL are preset reference voltages, where GammaH is the maximum reference voltage, and GammaL is a preset minimum reference voltage, the value of Data has a fixed correspondence with the input data signal of the data line, and the value range of Data is related to bit. Specifically, the value range of Data is $0\sim(2^{bit}-1)$. For example, when bit is 10, the value range of Data is 0~1023.

The initial reference voltage includes an initial GammaH value and an initial GammaL value. The adaptive adjustment reference voltage includes an adaptive adjustment GammaH value and the initial GammaL value, or the initial GammaH value and an adaptive adjustment GammaL value, or an adaptive adjustment GammaH value and an adaptive adjustment GammaL value. That is, the adjustment of the adaptive adjustment voltage can be achieved by adjusting the GammaH value, or by adjusting the GammaL value, or by adjusting the GammaH value and the GammaL value at the same time.

The following takes an example of adjusting the GammaH value to illustrate the adjustment method of the adaptive adjustment voltage. However, it is understood that the present disclosure is not limited to this.

Further, obtaining the adaptive adjustment voltage of the data line includes the following steps.

The adaptive adjustment reference voltage GammaH value is obtained.

The adaptive adjustment voltage $V_1$ of the data line is determined according to the adaptive adjustment reference voltage GammaH value and the input data signal.

In an embodiment, the driving method of the OLED display panel further includes adopting the following steps to set the adaptive adjustment reference voltages at different refresh frequencies:

choosing a reference refresh frequency; and for the i-th refresh frequency, obtaining the adaptive adjustment reference voltage corresponding to the i-th refresh frequency through the frequency switch process between the refresh frequency and the reference refresh frequency, where $i\in(1, n)$, and n is the category number of refresh frequencies different from the reference refresh frequency.

In an embodiment, the frequency switch process includes the following steps:

adjusting the adaptive adjustment reference voltage, so that the display panel does not flicker when switching between the reference refresh frequency and the i-th refresh frequency, and recording the current adaptive adjustment reference voltage as the adaptive adjustment reference voltage corresponding to the i-th refresh frequency.

For example, taking 60 Hz as the reference refresh frequency, the brightness value at a specific gray scale is measured, and recorded as lum0.

Then, the brightness values at other different refresh frequencies under the same gray scale are measured, and recorded as lum1, lum2, lum3 . . . lumx.

Taking the adjustment of GammaH value as an example, through the frequency switch process, the GammaH value is continuously adjusted, until a voltage value V1 is found, which makes lum1, lum2, lum3 . . . lumx infinitely close to lum0. The evaluation standard here can be whether human eyes observe or not the brightness change or flicker, until no one's eyes can see the flicker and the current GammaH value is recorded.

In practical applications, when the reference refresh rate is 60 Hz and the refresh rate is reduced relative to 60 Hz, if the GammaH value is increased by 10-20 mV, the brightness of the OLED at low frequencies can be reduced to a level comparable as that at 60 Hz, thus avoiding the visibility of the display brightness change of the display panel to human eyes.

In an embodiment, after detecting the data signal processing phase in which the display panel is currently located, the method further includes the following steps.

It is determined whether the current data signal processing phase of the display panel is consistent with the data signal processing phase at the previous moment. If they are consistent, the current reference voltage is kept unchanged.

If they are inconsistent, the current reference voltage is adjusted. That is, when the phase is switched, the reference voltage GammaH value and/or GammaL value is switched, so as to realize the switching of the power supply voltage of the data line.

In an embodiment, if they are inconsistent, the adjustment of the current reference voltage includes the following steps.

If the display panel is currently in the blanking region of the blanking phase but in the active region of the active transmission phase at the previous moment, the adaptive adjustment reference voltage is used to replace the reference voltage at the previous moment.

If the display panel is currently in the active transmission phase but in the blanking phase at the previous moment, the initial reference voltage is used to replace the reference voltage at the previous moment.

Figure 14:
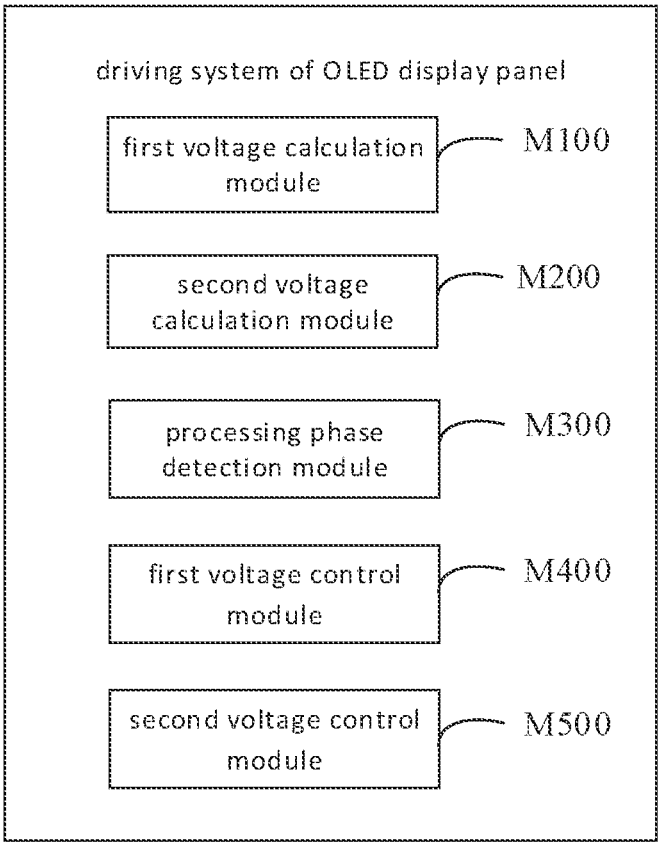
FIG. 14 is a schematic structural diagram of a driving system of an OLED display panel in an embodiment of the disclosure.

As shown in FIG. 14, an embodiment of the present disclosure also provides a driving system of an OLED display panel, which adopts the driving method of an OLED display panel. The system includes:

a first voltage calculation module M100, configured to determine the initial power supply voltage of the data line according to the input data signal;

a second voltage calculation module M200, configured to determine the adaptive adjustment voltage of the data line according to the current refresh frequency;

a processing phase detection module M300, configured to detect the data signal processing phase in which the display panel is currently located;

a first voltage control module M400, configured to set the power supply voltage of the data line to the initial power supply voltage if the display panel is currently in the active transmission phase; and a second voltage control module M500, configured to set the power supply voltage of the data line to the adaptive adjustment voltage if the display panel is currently in the blanking phase.

In an embodiment, the first voltage calculation module determines the initial power supply voltage of the data line according to the initial reference voltage and the input data signal. The second voltage calculation module queries the adaptive adjustment reference voltage corresponding to the current refresh frequency according to the correspondence between the preset refresh frequency and the adaptive adjustment reference voltage, and further determines the adaptive adjustment voltage of the data line according to the adaptive adjustment reference voltage and the input data signal.

The system also includes a reference voltage setting module for selecting a reference refresh frequency. For the i-th refresh frequency, the adaptive adjustment reference voltage corresponding to the i-th refresh frequency is obtained through a frequency switch process between the refresh frequency and the reference refresh frequency, where $i\in(1, n)$, and n is the category number of refresh frequencies that are different from the reference refresh frequency.

Compared with the prior art, using the driving method and system of the OLED display panel of the present disclosure, the power supply voltage of the data line is adjusted during the blanking phase, and the brightness change caused by the change of the refresh frequency of the display panel is reduced, This avoids visible flicker to human eyes when the refresh frequency changes, and improves the display effect of the display panel.

Figure 15:
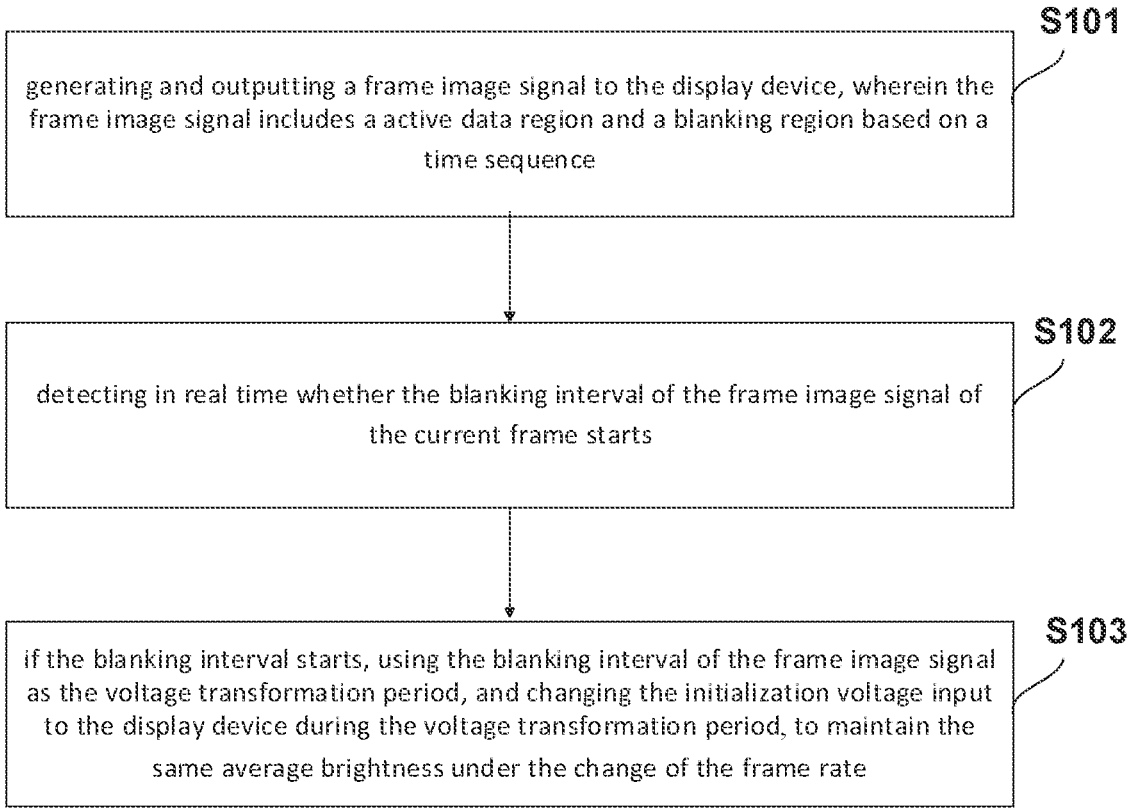
FIG. 15 is a schematic flowchart of a driving method of a display device in an embodiment of the present disclosure.

FIG. 15 is a schematic flowchart of a driving method of a display device in the present disclosure. As shown in FIG. 15, an aspect of the present disclosure provides a driving method of a display device, including the following steps.

In S101, a frame image signal is generated and outputted to the display device, wherein the frame image signal includes an active data region and a blanking region based on a time sequence.

In S102, it is detected in real time whether the blanking interval of the frame image signal of the current frame starts.

In S103, if the blanking interval starts, the blanking interval of the frame image signal is used as the voltage transformation period, and the initialization voltage input to the display device is changed during the voltage transformation period, to maintain the same average brightness under the change of the frame rate.

The present disclosure can reduce the brightness of part of the low frame rates, to achieve the goal of keeping the average brightness of all frame rates consistent. Thereby, the brightness change at low gray scales when the frame rate changes dynamically is improved, and the user experience when using the OLED display is optimized.

In an embodiment, the duration of the voltage transformation period decreases as the frame rate increases, and the duration of the voltage transformation period increases as the frame rate decreases.

In an embodiment, the initialization voltage is switched from the preset voltage level to the regulated voltage level after the voltage transformation period starts.

In an embodiment, the initialization voltage is switched from the regulated voltage level to the preset voltage level after the voltage transformation period ends.

In an embodiment, when the frame rate of the frame image signal is equal to the highest frame rate of the display device, the voltage transformation period is cancelled.

In an embodiment, according to the duration of the frame image signal of the current frame, and based on the duration percentage of the preset voltage transformation period in the frame image signal, the increase or decrease value of the initialization voltage in the voltage transformation period of the current frame image signal is obtained.

In the application of Variable Refresh Rate (VRR) technology, the change of the frame rate is reflected in the duration of the Vtotal of each frame. After using the driving method of the display device of the present disclosure, the length of time for changing the Vint voltage is determined according to the time of Vtotal. Tat is, the time for high frame rate change is short, and the time for low frame rate change is long. The frame rate in VRR changes in real time, and the brightness difference at each frame rate needs to be kept as small as possible. The average brightness is kept constant by changing the Vint voltage. According to the measured brightness curves of 32 gray scale at different frame rates, it can be seen that after using the present application, the brightness changes at different frame rates will be significantly improved.

In the video signal mode of the VRR application, the frame rate range of VRR is from (display frame rate/2.4) to (display frame rate). That is, if the display frame rate is 60 Hz, the range is from 25 Hz to 60 Hz. If the display frame rate is 144 Hz, the range is from 60 Hz to 144 Hz, wherein Vtotal=active+blank. The composition of the video signal is an active part and a blanking part, and the active part always has the length of one frame of the display frame rate. In order to keep the frame rate of the display synchronized with the frame rate of the GPU, in the VRR application, a blanking part of variable length will follow after the active part is transmitted, and the common length between the two is used as the output of one frame. The length of the blanking part determines the frame rate of the frame. The blanking part at the low frame rate is long, and the blanking part at the high frame rate is short.

In an embodiment, the initialization voltage is increased at least when the blanking region is displayed, to reduce the operating current of the display device.

In an embodiment, according to the duration of the active data region and the duration of the blanking region of the frame image signal of the current frame, the decrease value of the initialization voltage in the voltage transformation period of the current frame image signal is obtained.

Figure 16:
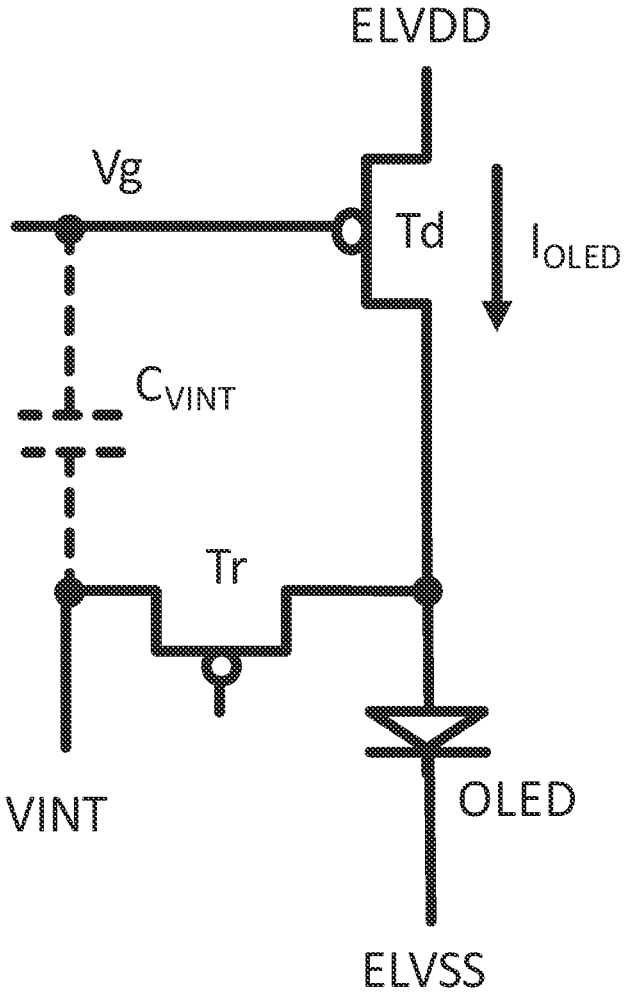
FIG. 16 is a circuit diagram of a display device in an embodiment of the present disclosure.

FIG. 16 is a circuit diagram of the display device in the present disclosure. As shown in FIG. 16, another aspect of the present disclosure provides a display device for implementing the aforementioned driving method of the display device. The display device includes:

a driving TFT (Td), having the source connected to the driving voltage, and the drain connected to the anode of an organic light emitting diode; and a restart TFT (Tr), having the source connected to the initialization voltage Vint, and the drain connected to the anode of the organic light emitting diode, wherein a parasitic capacitance $C_{VINT}$ is formed between the gate of the driving TFT (Td) and the gate of the restart TFT (Tr).

A frame of image signal is generated and outputted to the organic light emitting diode OLED. It is detected in real time whether the blanking interval of the frame image signal of the current frame starts. If it starts, the blanking interval of the frame image signal is used as the voltage transformation period, and the initialization voltage Vint input to the display device is changed during the voltage transformation period, to maintain the same average brightness under the change of the frame rate. The main technical features of the display device are the same as the aforementioned driving method, which will not be repeated here.

In an embodiment, the duration of the voltage transformation period decreases as the frame rate increases, and the duration of the voltage transformation period increases as the frame rate decreases.

In an embodiment, the initialization voltage is switched from the preset voltage level to the regulated voltage level after the voltage transformation period starts.

In an embodiment, the initialization voltage is switched from the regulated voltage level to the preset voltage level after the voltage transformation period ends.

In an embodiment, when the frame rate of the frame image signal is equal to the highest frame rate of the display device, the voltage transformation period is cancelled.

In an embodiment, according to the duration of the frame image signal of the current frame, and based on the duration percentage of the preset voltage transformation period in the frame image signal, the increase or decrease value of the initialization voltage in the transformation period of the current frame image signal is obtained.

In an embodiment, the initialization voltage is increased at least when the blanking region is displayed, to reduce the operating current of the display device.

In an embodiment, according to the duration of the active data region and the duration of the blanking region of the frame image signal of the current frame, the decrease value of the initialization voltage in the voltage transformation period of the current frame image signal is obtained.

Figure 17:
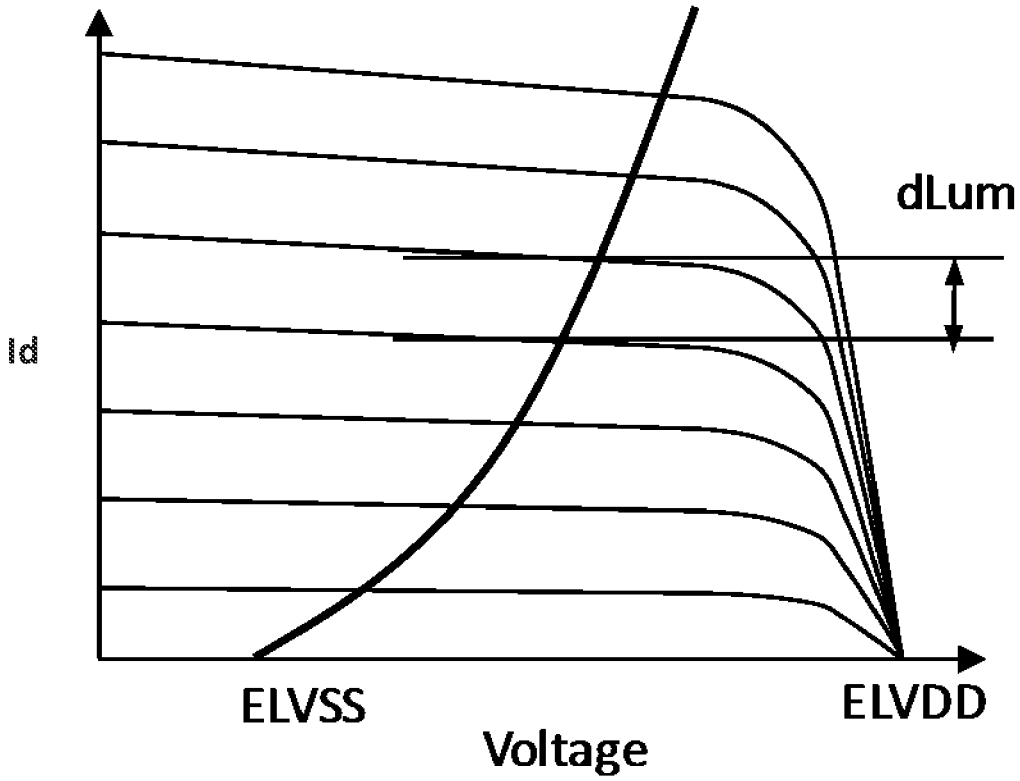
FIG. 17 is a graph of the voltage and the current of the thin film transistor operating in the saturation region in a driving method of a display device in an embodiment of the present disclosure.

FIG. 17 is a graph of the voltage and the current of the thin film transistor operating in the saturation region in the driving method of the display device in the present disclosure. Referring to FIGS. 16 and 17, in the OLED pixel driving circuit, there is a parasitic capacitance $C_{VINT}$ between the initialization voltage Vint and the gate of the driving TFT (Td). When the restart TFT (Tr) is turned off, if the Vint voltage changes, due to the existence of $C_{VINT}$, The voltage of Vg will change accordingly. According to the Id-Vd characteristic curve of the TFT, the change of Vgs will cause the Id to change. The specific change is as follows. When the Vint voltage increases, the voltage Vg on the other side of $C_{VINT}$ will increase, resulting in a decrease in the current $I_{OLED}$, and finally causing the OLED luminous brightness to lower. When the Vint voltage becomes smaller, the voltage Vg on the other side of the $C_{VINT}$ will decrease, resulting in an increase in the current $I_{OLED}$, and finally causing a higher brightness of the OLED. Therefore, the Vint can be changed to give a slight change of Vg, so as to control the current through the OLED for the purpose of changing the brightness of the OLED.

Figure 18:
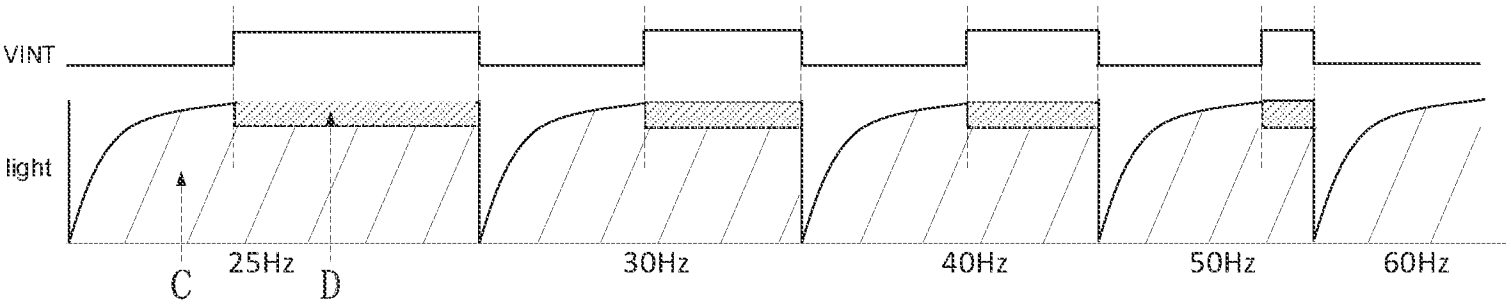
FIG. 18 is a schematic implementation diagram of a driving method of a display device in an embodiment of the present disclosure.

FIG. 18 is a schematic diagram of the implementation process of the driving method of the display device in the present disclosure. Referring to FIG. 18, the area C filled with thick diagonal lines is the actual brightness part of the display, and the area D filled with thin diagonal lines is the brightness part reduced by changing the initialization voltage Vint. When the frame rate changes, the length of the Vtotal of each frame changes. The length of time for changing the initialization voltage Vint depends on the time of Vtotal. That is, the time for high frequency change is short, and the time for low frequency change is long. Since the active part at different frame rates has the same length, the length of the blanking part is different. So, the blanking part in Vtotal partially changes the Vint voltage, so that the brightness of each frame at each frame rate of 25 HZ, 30 HZ, 40 HZ, 50 HZ, 60 HZ, etc. is kept consistent.

Figure 19:
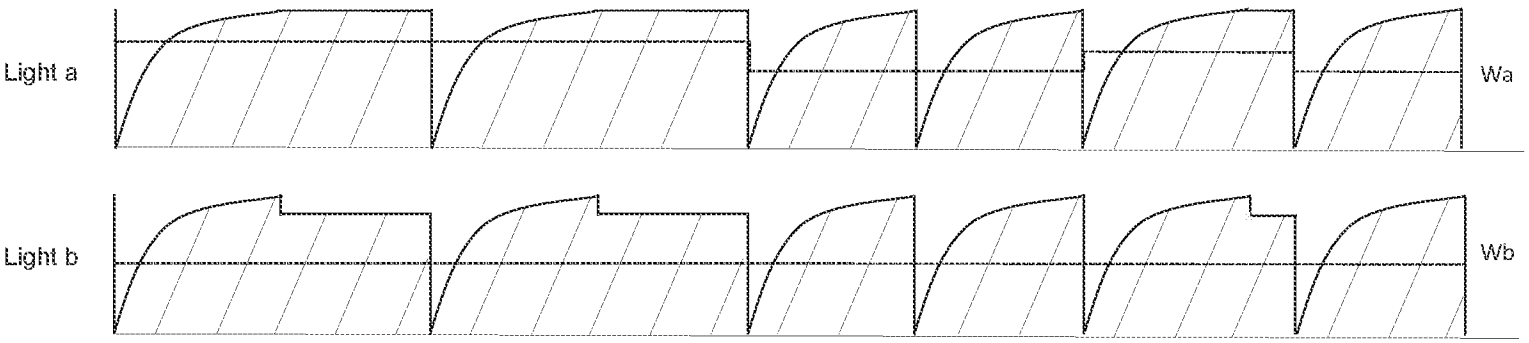
FIG. 19 is a schematic diagram of comparison in brightness and timing between the driving method of the display device in an embodiment of the present disclosure and the prior art.

FIG. 19 is a schematic diagram of comparison in brightness and timing between the driving method of the display device in the present disclosure and the prior art. Referring to FIG. 19, light a is the brightness v.s. timing curve of the prior art, Wa is the average of the brightness at each frame rate in the prior art, and the brightness value of Wa at each frame rate changes repeatedly. Light b is the brightness v.s. timing curve of the present disclosure, and Wb is the average value of the brightness at each frame rate of the present disclosure. The brightness Wb at each frame rate remains consistent. By comparison, it can be seen that the present disclosure can reduce the brightness of some low frame rates, to achieve the goal of keeping the average brightness of all frame rates consistent, thereby improving the brightness changes at low gray scales when the frame rate changes dynamically, and optimizing the user experience when using the OLED display.

In summary, the driving method of the display device and the display device of the present disclosure can achieve the goal of keeping the average brightness at all frame rates consistent by reducing the brightness of part of the low frame rates, thereby improving the brightness change at low gray scales when the frame rate changes dynamically, and optimizing the user experience when using the OLED display.

The above content is a further detailed description of the present disclosure in conjunction with specific implementations, and it cannot be considered that the specific implementations of the present disclosure are limited to these descriptions. For those of ordinary skill in the technical field to which the present disclosure belongs, several simple deductions or substitutions can be made without departing from the concept of the present disclosure, and they should all be regarded as falling within the protection scope of the present disclosure.

The invention claimed is:

1. A driving method of a display panel, comprising:

detecting the display panel entering a variable refresh rate mode;

determining a target refresh rate range according to a refresh rate range of the variable refresh rate mode, wherein the target refresh rate range is from a minimum value of the refresh rate range to a target threshold;

determining whether a refresh rate of a current frame is within the target refresh rate range according to a frame signal of the current frame; and in response to determining that the refresh rate of the current frame is within the target refresh rate range, adjusting a first level voltage of a scan signal in a blanking phase of the current frame, so that a voltage difference between the first level voltage and a second level voltage of the scan signal in the blanking phase is greater than a voltage difference between the first level voltage and the second level voltage of the scan signal in an active phase of the current frame.

2. The driving method of claim 1, further comprising:

if determining that the refresh rate of the current frame is not within the target refresh rate range, keeping the first level voltage of the scan signal in the blanking phase equal to the first level voltage of the scan signal in the active phase.

3. The driving method of claim 1, wherein when the scan signal is at the first level voltage, in a pixel circuit of the display panel, except for that a driving transistor that drives a light emitting element of the pixel circuit to emit light is in an on state, all remaining transistors are in an off state; and the scan signal acts on control terminals of the remaining transistors, and in the blanking phase, an adjusted first level voltage of the scan signal reduces a current through the light emitting element, through a parasitic capacitance generated by the remaining transistors in the pixel circuit.

4. The driving method of claim 3, wherein transistors in the pixel circuit are all PMOS transistors, the first level voltage of the scan signal is a high level voltage VGH, and the second level voltage of the scan signal is a low level voltage VGL; and the adjusting the first level voltage of the scan signal in the blanking phase of the current frame comprises:

increasing the high level voltage VGH of the scan signal in the blanking phase.

5. The driving method of claim 3, wherein transistors in the pixel circuit are all NMOS transistors, the first level voltage of the scan signal is a low level voltage VGL, and the second level voltage of the scan signal is a high level voltage VGH; and the adjusting the first level voltage of the scan signal in the blanking phase of the current frame comprises:

decreasing the low level voltage VGL of the scan signal in the blanking phase.

6. The driving method of claim 3, wherein the pixel circuit of each pixel of the display panel comprises:

a first transistor, having a first terminal coupled to an initialization voltage terminal, a second terminal coupled to a first node, and a control terminal receiving a first scan signal;

a second transistor, having a first terminal coupled to a data line, a second terminal coupled to the first node, and a control terminal receiving a second scan signal;

a third transistor, having a first terminal coupled to an anode of the light emitting element, a second terminal coupled to the initialization voltage terminal, and a control terminal receiving a third scan signal;

a driving transistor, having a first terminal coupled to the anode of the light emitting element, a second terminal coupled to an anode power terminal, and a control terminal coupled to the first node; and a storage capacitor, coupled between the first node and the anode power terminal, wherein when the scan signal is at the first level voltage, the driving transistor is turned on, and the first transistor, the second transistor, and the third transistor are turned off.

7. The driving method of claim 6, wherein the adjusting the first level voltage of the scan signal in the blanking phase of the current frame comprises:

adjusting the first level voltages of the first scan signal, the second scan signal, and the third scan signal in the blanking phase, so that when the current frame enters the blanking phase, the first scan signal, the second scan signal, and the third scan signal are adjusted simultaneously.

8. The driving method of claim 6, wherein a working process of the pixel circuit in the active phase comprises:

in a first reset phase, turning on the first transistor in response to the second level voltage of the first scan signal, and initializing, by an initialization voltage signal of the initialization voltage terminal, the control terminal of the driving transistor and the storage capacitor;

in a charging phase, turning on the second transistor in response to the second level voltage of the second scan signal, and charging, by a data voltage signal of the data line, the control terminal of the driving transistor and the storage capacitor;

in a second reset phase, turning on the third transistor in response to the second level voltage of the third scan signal, and initializing, by the initialization voltage signal, the anode of the light emitting element; and in a display phase, turning on the driving transistor to drive the light emitting element to emit light.

9. A driving method of an OLED display panel, comprising:

determining an initial power supply voltage of a data line according to an input data signal;

obtaining an adaptive adjustment voltage of the data line;

detecting a data signal processing phase in which the display panel is currently located;

If the display panel is currently in an active transmission phase, setting a power supply voltage of the data line to be the initial power supply voltage; and If the display panel is currently in a blanking phase, setting the power supply voltage of the data line to be the adaptive adjustment voltage, wherein the driving method further comprises setting the adaptive adjustment reference voltage by:

choosing a reference refresh frequency; and for an i-th refresh frequency, obtaining the adaptive adjustment reference voltage corresponding to the i-th refresh frequency through a frequency switch process between the refresh frequency and the reference refresh frequency, wherein i ∈(1, n), and n is a category number of refresh frequencies different from the reference refresh frequency.

10. The driving method of claim 9, wherein the frequency switch process comprises:

adjusting the adaptive adjustment reference voltage, so that the display panel does not flicker when switching between the reference refresh frequency and the i-th refresh frequency, and recording a current adaptive adjustment reference voltage as the adaptive adjustment reference voltage corresponding to the i-th refresh frequency.

11. The driving method of claim 9, further comprising:

after detecting the data signal processing phase in which the display panel is currently located, determining whether the data signal processing phase in which the display panel is currently located is consistent with the data signal processing phase at a previous moment;

if being consistent, keeping the current reference voltage unchanged; and if being inconsistent, adjusting the current reference voltage.

12. The driving method of claim 11, the adjusting the current reference voltage if being inconsistent comprises:

if the display panel is currently in the blanking phase but in the active transmission phase at the previous moment, using the adaptive adjustment reference voltage to replace the reference voltage at the previous moment; and If the display panel is currently in the active transmission phase but in the blanking phase at the previous moment, using the initial reference voltage to replace the reference voltage at the previous moment.

13. The driving method of claim 9, wherein the determining the initial power supply voltage of the data line according to the input data signal comprises determining the initial power supply voltage of the data line according to an initial reference voltage and the input data signal.

14. The driving method of claim 13, wherein the obtaining the adaptive adjustment voltage of the data line comprises:

obtaining an adaptive adjustment reference voltage; and determining the adaptive adjustment voltage of the data line according to the adaptive adjustment reference voltage and the input data signal.

15. The driving method of claim 14, wherein the power supply voltage $V_{DATA}$ of the data line meets a formula (1) of:

$$V_{DATA} = GammaH - \frac{GammaH - GammaL}{2^{bit} - 1} \times \text{Data} \quad (1)$$

wherein, Data is an input parameter obtained according to the input data signal of the data line, bit is a preset coefficient, GammaH and GammaL are preset reference voltages, GammaH is a maximum reference voltage, GammaL is a preset minimum reference voltage, a fixed correspondence exists between a value of Data and the input data signal of the data line, and a value range of Data is from 0 to $(2^{bit}-1)$;

the initial reference voltage comprises an initial GammaH value and an initial GammaL value; and the adaptive adjustment reference voltage comprises an adaptive adjustment GammaH value and the initial GammaL value, or the initial GammaH value and an adaptive adjustment GammaL value, or an adaptive adjustment GammaH value and an adaptive adjustment GammaL value.

16. A driving method of a display device, comprising:

generating a frame image signal, and outputting the frame image signal to the display device, the frame image signal comprising an active data region and a blanking region based on a time sequence;

detecting in real time whether a blanking interval of the frame image signal of a current frame starts; and if starting, using the blanking interval of the frame image signal as a voltage transformation period, and changing an initialization voltage input to the display device during the voltage transformation period, to maintain a same average brightness with a change in frame rate.

17. The driving method of claim 16, wherein a duration of the voltage transformation period decreases as the frame rate increases, and the duration of the voltage transformation period increases as the frame rate decreases.

18. The driving method of claim 16, wherein the initialization voltage is switched from a preset voltage level to a regulated voltage level after the voltage transformation period starts, and the initialization voltage is switched from the regulated voltage level to the preset voltage level after the voltage transformation period ends.

19. The driving method of claim 16, wherein an increase or decrease value of the initialization voltage in the voltage transformation period of a current frame image signal is obtained, according to a duration of the frame image signal of the current frame, and based on a duration percentage of a preset voltage transformation period in the frame image signal; or the initialization voltage is increased at least when the blanking region is displayed, to reduce an operating current of the display device, and an decrease value of the initialization voltage in the voltage transformation period of a current frame image signal, according to a duration of the active data region and a duration of the blanking region of the frame image signal of the current frame.

* * * * *